US005742210A

United States Patent [19]

Chaturvedi et al.

[11] Patent Number: 5,742,210

[45] Date of Patent: Apr. 21, 1998

[54] NARROW-BAND OVERCOUPLED DIRECTIONAL COUPLER IN MULTILAYER PACKAGE

[75] Inventors: Rahul Chaturvedi; Richard Kommrusch, both of Albuqerque, N. Mex.

[73] Assignee: Motorola Inc., Schaumburg, Ill.

[21] Appl. No.: 799,516

[22] Filed: Feb. 12, 1997

[51] Int. Cl.[6] ..... H01P 5/18

[52] U.S. Cl. ..... 333/116; 333/238

[58] Field of Search ..... 333/116, 238, 333/246

[56] References Cited

U.S. PATENT DOCUMENTS 5,359,304 10/1994 Fujiki ..... 333/116
5,369,379 11/1994 Fujiki ..... 333/116
5,557,245 9/1996 Taketa et al. ..... 333/116

*Primary Examiner*—Paul Gensler
*Attorney, Agent, or Firm*—Gary J. Cunningham; Colin M. Raufer

[57] ABSTRACT

A narrow-band overcoupled directional coupler 300 in a multilayer package is provided. The directional coupler 300 has a laminated structure including a stack of dielectric substrates (301–310) with a primary and a secondary transmission line on the layers of the dielectric substrates. The primary transmission line (A) and the secondary transmission line (B) are coupled by a combination of edge type coupling in which the primary and secondary transmission lines are substantially parallel with each other on a major surface of one of the dielectric substrates (307 for example) and broadside type coupled in which at least portions of the primary transmission line and secondary transmission line are substantially vertically aligned through adjacent dielectric substrates (303, 305 for example). The primary and secondary transmission lines are also substantially overcoupled to provide a predetermined off-center frequency which is different from an overcoupled center frequency.

20 Claims, 5 Drawing Sheets

-PRIOR ART-

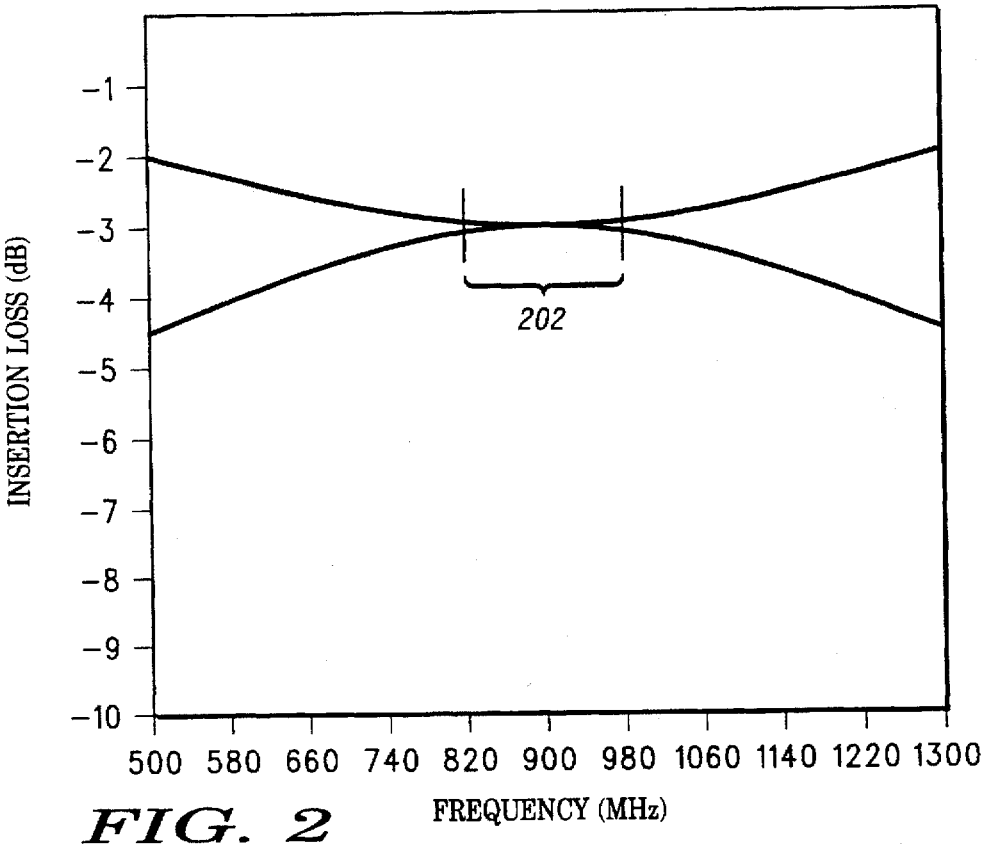
FIG. 2
FIG. 6
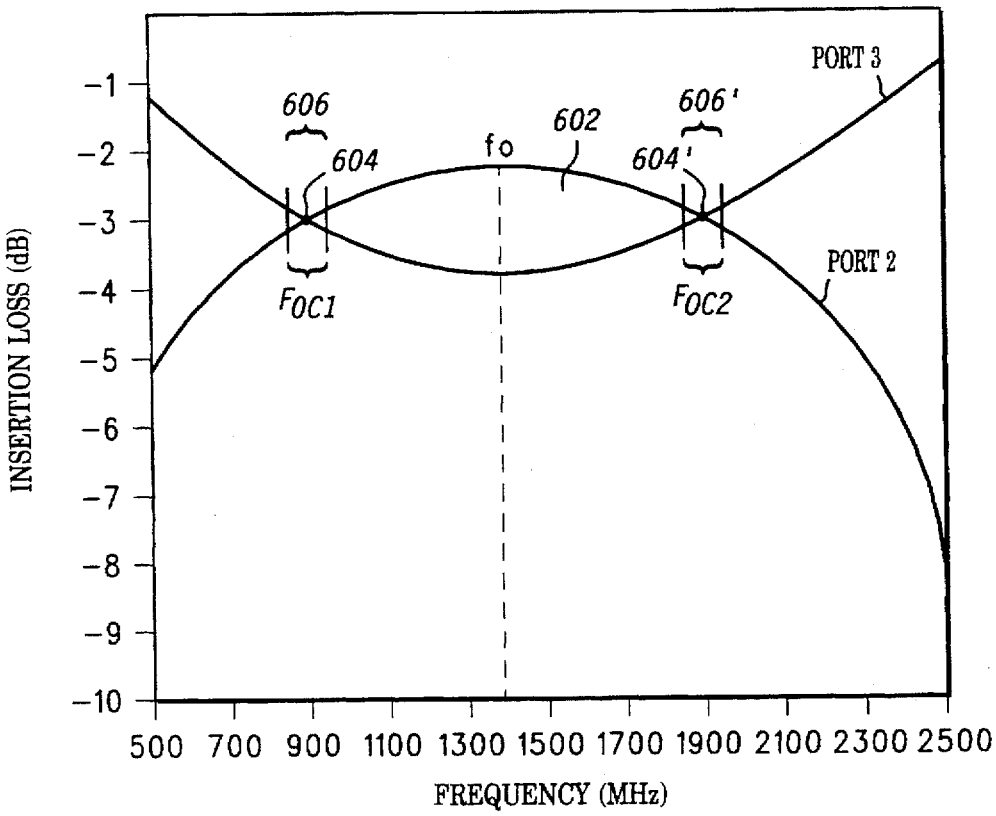

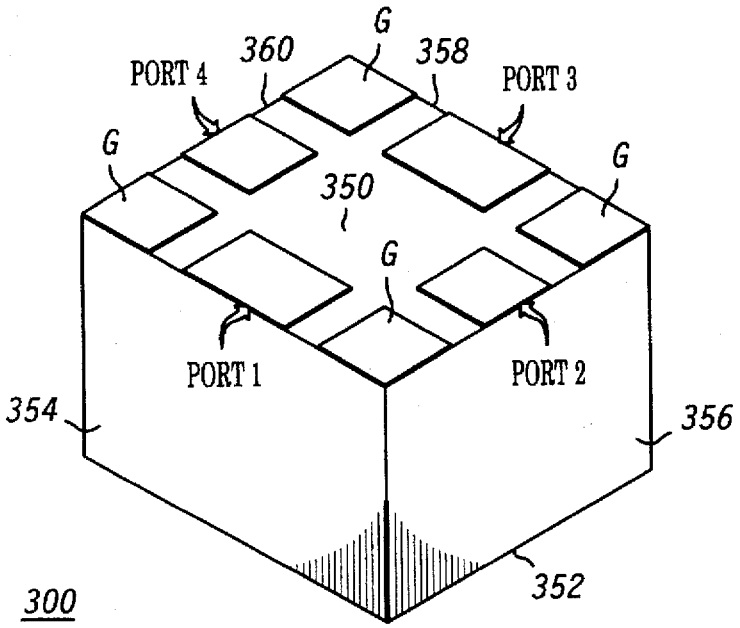
FIG. 3
FIG. 4
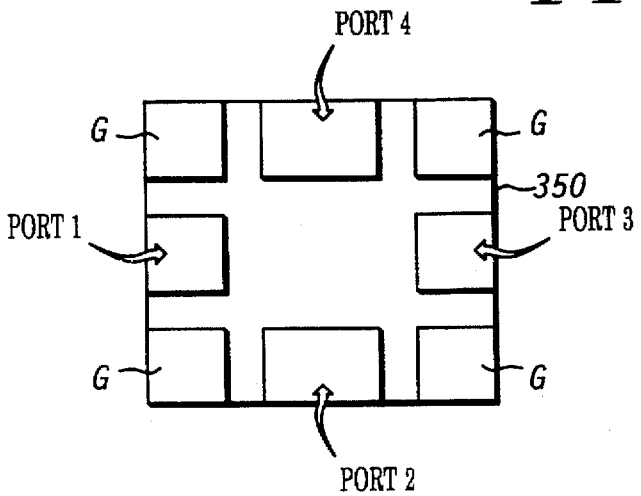

NARROW-BAND OVERCOUPLED DIRECTIONAL COUPLER IN MULTILAYER PACKAGE

FIELD OF THE INVENTION

This invention relates to directional couplers, and more particularly to Narrow-Band Overcoupled Directional Coupler In a Multilayer Package.

BACKGROUND OF THE INVENTION

Directional couplers are well known in the art. A directional coupler is a four port circuit element which is adapted to provide an output which is proportional only to the incident power from a source. Within a frequency band, a typical directional coupler will divide incident power from a source into two outputs at phase quadrature. The ratio of each output power to the input power will be known for an arbitrary set of impedances connected to the four port device.

A directional coupler is a well known component for radio frequency equipment. This component allows a sample of a radio frequency or microwave signal, which is input at an input terminal and output at an output terminal, to be extracted from the input signal. Properly designed, the directional coupler can distinguish between a signal input at the input terminal and a signal input at the output terminal. This characteristic is of particular use in a radio frequency transmitter in which both the input signal and a signal which is reflected from a mismatched antenna can be independently monitored. One or the other or both of these signals can be utilized in a power control circuit to control the output power of the transmitter, for example.

The operation of directional couplers is well known. A conventional directional coupler of the prior art is shown in FIG. 1 For a 3 dB and 90 degree power divider, an input signal will come to a Port 1. One half of the input signal comes out a Port 2, called the "coupled port". One half of the input signal comes out a Port 3, called the "direct port". No signal comes out from the Port 4, called the "isolated port". Moreover, the signals coming out from Ports 2 and 3 are 90 degrees out of phase with each other. In FIG. 1, the directional coupler is shown in a multilayer package with four layers 102, 104, 106, and 108. Directional couplers are usually placed between two ground planes, namely the metallized top surface of dielectric sheet 102 called GP1 and the metallized top surface of sheet 108 called GP2.

Directional couplers typically have a primary and a secondary transmission line. Due to the coupling mode of the portions which are horizontally close to each other over the length of these transmission lines, a fraction of the power which is applied at Port 1 of the primary transmission line is produced at a Port 2 in the secondary transmission line.

One typical application for a directional coupler, for example, may be for sampling a high frequency signal in a portable telephone. Other applications include balanced amplifiers, double balanced mixers and dual switches.

One implementation of a directional coupler is to place a pair of co-axially wound, coiled quarter-wave transmission lines between two ground planes in a multilayer ceramic package. Typically, each layer in a package will contain just one of the transmission line electrode patterns. As such, each of the transmission lines will extend through alternate layers in the ceramic package.

Unfortunately, due to the size restraints on radio frequency/microwave components and systems, these directional coupler designs are impractical for many present and future applications. The transmission lines designs in conventional multilayer packages require many dielectric layers and many processing steps.

Directional coupler transmission lines often extend over a large area in an electronic package. In a known medium, for a given electrical length at a frequency of interest, the physical length of a transmission line will be a constant. For example, in a material with a relative permittivity of 7.8, a quarter wave transmission line at 900 MHz will have a physical length of about 1.167 inches.

Since traditional directional couplers require quarter wave length transmission lines, a directional coupler for a 900 MHz application will be at least 1.167 inches long in a stripline or microstrip implementation. Since a component having a transmission line of this length on a single dielectric substrate layer would be undesirably large in a cellular telephone for example, one solution has been to make a multilayer ceramic package having a transmission line embedded between its layers.

FIG. 2 shows the power line characteristics for a prior art directional coupler design. More specifically, FIG. 2 shows the directional coupler output port power lines, measured as a function of frequency, shown relative to the input power at Port 1. Using conventional prior art coupling techniques, the coupler output port power lines (power line characteristics) are brought together until they define a coupling region 202. In FIG. 2, Insertion Loss, measured in decibels (dB) is shown along the vertical axis and Frequency, measured in mega-hertz (MHz) is shown along the horizontal axis.

Some multilayer packages containing directional couplers have been presented in which a portion of each transmission line is placed on each of the dielectric layers, resulting in a small package size. However, the limits for multilayer packages are being reached using conventional directional coupler coupling techniques. Of course, by using alternative dielectrics or alternative multilayer designs, package size may be decreased. Nevertheless, these designs are limited by the fact that they all use quarter-wave transmission lines and these packages will still be undesirably large for many applications.

A novel directional coupler in an ultra small package that uses an overcoupled technique to achieve shorter transmission lines, and is made in a multilayer package with a unique transmission line design, preferably in which both transmission lines are placed parallel to each other on each layer and repeat alternatingly throughout the package, resulting in a small package size, would be an improvement in the art.

BRIEF DESCRIPTION OF THE DRAWINGS

FIG. 2 shows the power line characteristics for the prior art directional coupler, shown in FIG. 1.

FIG. 3 is a perspective view of a narrow band overcoupled directional coupler in a multilayer package, in accordance with the present invention.

FIG. 4 shows a plan view of the bottom surface of the bottom layer of the directional coupler of FIG. 3 in accordance with the present invention.

FIG. 6 shows the overcoupled coupler power line characteristics for a directional coupler in accordance with the present invention.

DETAILED DESCRIPTION OF THE PREFERRED EMBODIMENTS

Figure 1:
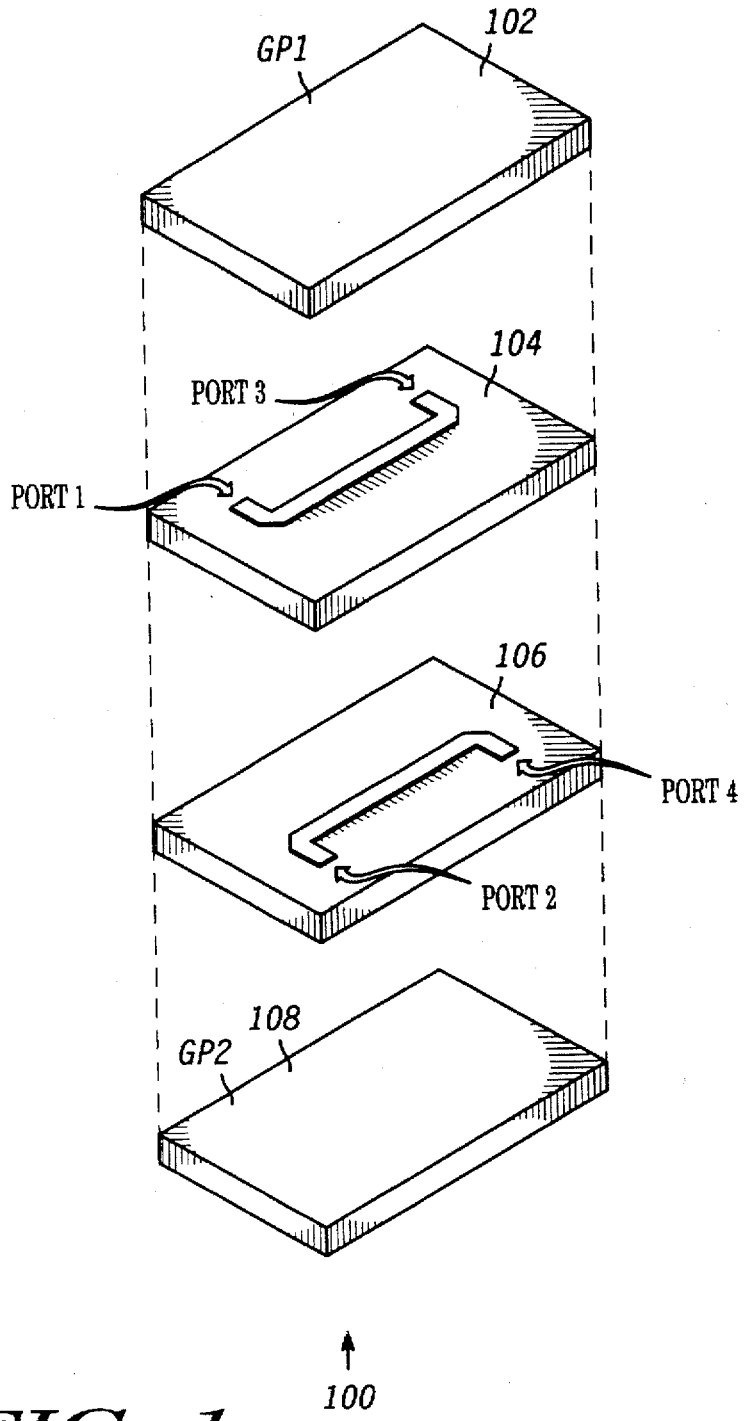
FIG. 1 shows a prior art directional coupler.

FIG. 3 is a perspective view of a narrow band overcoupled directional coupler in a multilayer package. This directional coupler package has a mounted bottom surface 350, a mounted top surface 352, and four side surfaces 354, 356, 358 and 360. Surface 350 is called the mounted bottom surface because it contains the input, output, and isolation Ports which will be on the bottom of the directional coupler when the part is mounted on a printed circuit board. The bottom surface 350 of directional coupler 300 has a metallized pattern in which the four corners define grounds (designated by the letter "G"), and the four ports of the directional coupler are labeled and shown in between the corner grounds. A buried ground plane layer, visible from the exploded view of FIG. 5, is located on a layer below bottom surface 350, shown as sheet 309 in FIG. 5.

FIG. 4 shows a plan view of the bottom surface of the bottom layer of the directional coupler of FIG. 3. From this view, the corner grounds (designated by the letter "G") and the four ports of the directional coupler are shown. A buried ground plane layer, visible from the exploded view of FIG. 5, referred to as item 309, is located on a layer below bottom surface 350.

The metallization pattern of FIG. 4 is designed for ease of part testing in a fixture. One method of testing a part (directional coupler) involves placing it in a fixture such that the fixture probes make contact with a "port" and a "ground". By designing the bottom surface 350 of the directional coupler 300 in the manner as shown in FIG. 4, the part (directional coupler) is easily tested for electrical characteristics in a fixture with co-planar probes.

Figure 5:
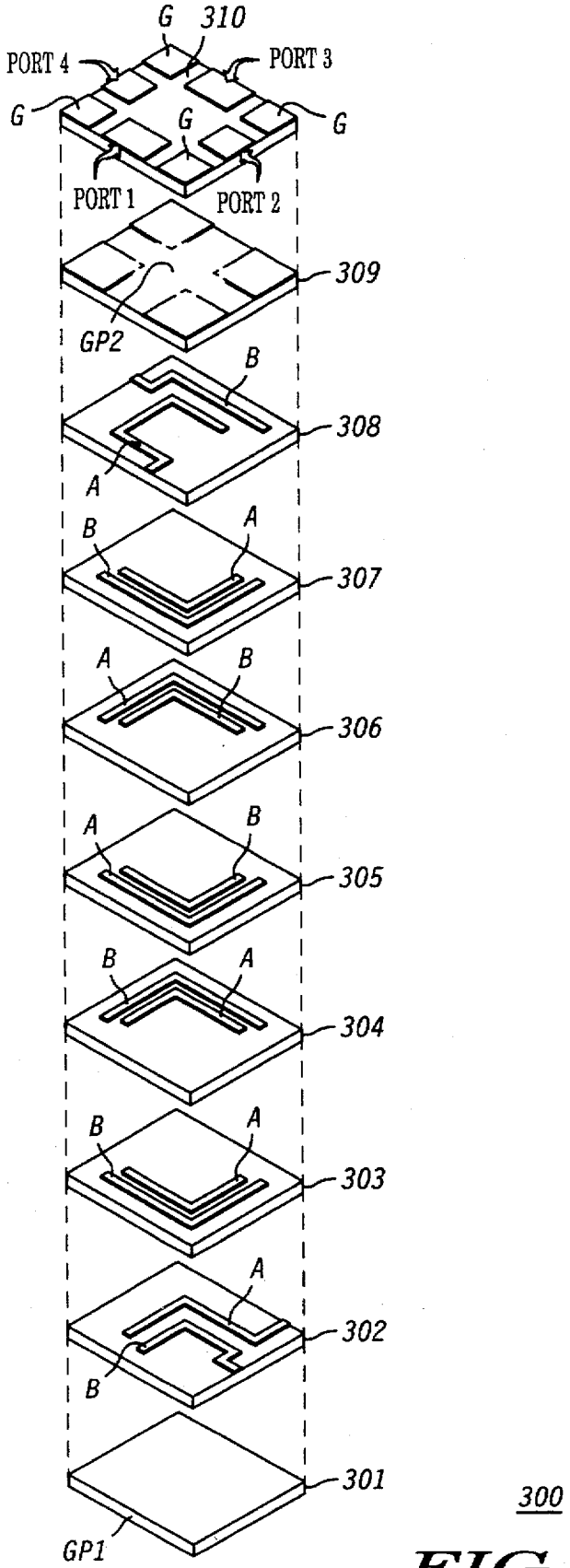
FIG. 5 shows an exploded view of the directional coupler of FIG. 3 in accordance with the present invention.

FIG. 5 shows an exploded view of the directional coupler 300 of FIG. 3. FIG. 5 shows a directional coupler made from a stack of ten laminated sheets of dielectric ceramic numbered 301 through 310, respectively. In this embodiment, the overcoupled design is incorporated into a multilayer package in which the transmission lines are coupled by a combination of edge type coupling and broadside type coupling. In the edge type coupling design, at least portions of the primary transmission line and the secondary transmission line are substantially parallel with each other on a major surface of the dielectric substrates 302–308. The broadside type coupling comprises at least portions of the primary transmission line and the secondary transmission line being substantially vertically aligned through an adjacent dielectric substrate. In this embodiment, the broadside coupling is repeated through alternating layers of the multilayer package. For example, the transmission line patterns on sheets 304 and 306 are substantially vertically aligned. Similarly, the transmission line patterns on sheets 303, 305 and 307 are also substantially vertically aligned. In another embodiment shown in FIG. 7, discussed below, the broadside coupling is repeated through consecutive layers.

Referring to FIG. 5, sheet 301, which appears to be the bottom sheet in FIG. 5, will actually be the top sheet once the directional coupler package is mounted on a printed circuit board. The surface of sheet 301 is thus coated with a conductive material or metallization layer to define a first ground plane GP1.

Sheet 302 contains a primary transmission line (A) and a secondary transmission line (B) deposited on a major surface of sheet 302. The primary and the secondary transmission lines are substantially parallel with each other to define an edge type coupling technique.

It is important to note that the distance between the transmission lines (A, B) and the first ground plane GP1 may be substantially the same as the distance between the transmission lines (A, B) and the corresponding second ground plane GP2 at the other end of the multilayer package. This separation may be achieved by a variety of different techniques. For example, it may be feasible, in some instances, to insert unmetallized sheets of dielectric into the package to maintain the proper spacing between the transmission lines and the ground planes. In FIG. 5, a buried ground plane design is employed. In either case, an important design consideration involves properly separating and distancing the transmission lines (A, B) from the ground planes (GP1, GP2) of the multilayer package.

Sheet 303 contains a primary transmission line (A) and a secondary transmission line (B) deposited on a major surface of sheet 303. The transmission lines (A, B) are necessarily connected to the transmission lines on dielectric sheets 302 and 304 by a set of conductively filled vias which extend though the dielectric sheets. These vias, have been purposefully omitted from FIG. 5 for reasons of clarity. Nevertheless, it should be understood that vias connect the transmission lines on adjacent dielectric sheets. Additionally, a stack of vias (not shown) connect the ends of transmission lines (A) and (B) on sheet 302 to the direct output and coupled output pads on sheet 310.

Sheet 304 contains a primary transmission line (A) and a secondary transmission line (B) deposited on a major surface of sheet 304. Although this embodiment has transmission lines deposited by a screen-printing technique, any deposition technique may be used to strategically place the transmission lines on the dielectric sheets 301–310.

Sheet 305 contains a primary transmission line (A) and a secondary transmission line (B) deposited on a major surface. In this instance, the transmission line near the center of the sheet is secondary (B) transmission line. Note that this transmission line is vertically aligned with primary transmission line (A) on dielectric sheets 303 and 307. Hence, the broadside coupling technique aligns the transmission lines in a way which provides adequate coupling between the respective transmission lines (A, B).

Sheet 306 contains a primary transmission line (A) and a secondary transmission line (B) deposited on a major surface of sheet 306. These transmission lines are substantially parallel to each other defining an edge coupling technique. Additionally, the transmission lines on sheet 306 are substantially broadside coupled to the transmission lines on sheets 304 and 302.

Sheet 307 contains a primary transmission line (A) and a secondary transmission line (B) deposited on a major surface of sheet 307. The transmission lines are broadside coupled with the transmission lines on sheets 305 and 303.

Sheet 308 contains the a primary transmission line (A) and a secondary transmission line (B) deposited on a major surface of sheet 308. While sheet 302 was the first sheet containing transmission lines, sheet 308 is the last layer in the package which contains transmission lines. The transmission lines (A, B) on sheet 308 are then connected to the input, output and isolation ports through a set of vias.

In a preferred embodiment, the laminated structure will include an input pad and an output pad connected to the primary transmission line and an isolation port and an output connected to the secondary transmission line.

Sheet 309 contains a buried ground plane, or a surface of sheet 309 is substantially metallized to form a second or bottom ground plane GP2. The areas on sheet 309 immediately under the input, output and isolation ports on sheet 310 are not metallized in order to prevent shorting of the directional coupler.

Sheet 310 contains the input, output and isolation ports (Port 1, Port 2, Port 3, Port 4) as well as the grounds, designated by the letter "G". This patterning has been discussed in detail in connection with FIGS. 3 and 4.

In summary, when sheets 301 through 310 are laminated together and fired into a densified multilayer package, it provides an overcoupled directional coupler in which the primary and secondary transmission lines are coupled by a combination of edge type coupling and broadside type coupling.

FIG. 6 shows, in a graphic representation, the overcoupled design of the present invention. FIG. 6 shows the power line characteristics or coupler output port power lines of the directional coupler. The power output for Port 3, the through port, is shown as the line which originates with decreasing slope in FIG. 6. Similarly, the power output for Port 2, the coupled port, is shown as the line which originates with increasing slope in FIG. 6. The power outputs have been labeled as "Port 2" and "Port 3" in FIG. 6. For both lines, the power output is measured relative to the incident power at Port 1. Additionally, the power output is measured as a function of frequency, shown along the horizontal axis. Insertion Loss, measured in decibels (dB) is shown along the vertical axis.

The coupler output port power line for an overcoupled directional coupler will appear to be a parabolic curve which is intersected by another curve which is inversely-parabolic in shape. The cross-over region is the area between the curves, and the points of intersection of the curves are the nodal points.

The primary and secondary transmission lines creating coupler output port power lines are overcoupled to define an overcoupled region 602 which has an overcoupled center frequency ($f_o$) and a high-side half-power crossover node 604' and a low-side half-power crossover node 604. The area in proximity to the high-side half-power crossover node 604' defines a high-side half-power coupling region 606' and the area in proximity to the low-side half-power crossover node 604 defines a low-side half-power coupling region 606. The high-side half-power coupling region 606' and the low-side half-power coupling region 606 define a predetermined off-center frequency ($F_{OC2}$ and $F_{OC1}$ respectively) which is different from the overcoupled center frequency ($f_o$).

The high-side half-power coupling region 606' and the low-side half-power coupling region 606, resulting directly from the overcoupled design, offer a variety of design opportunities. In one embodiment, both the high-side half-power coupling region 606' and the low side half-power coupling region 606 set distinct half power points defining a dual band directional coupler. A dual band directional coupler may be useful for many telecommunication applications which involve using two distinct bands of the electromagnetic spectrum. For example, one band may be used as a directional coupler for the Advanced Mobile Phone Service (AMPS) cellular telephone band (low-side half-power coupling region 606) and the other band may be used at higher frequencies for a Personal Communications System (PCS) (high-side half-power coupling region 606').

A dual band directional coupler obviates the need for the design of two single-band couplers or one extremely wide band coupler for use in radios and telecommunications equipment such as an Advanced Mobile Phone Service/Personal Communication Systems AMPS/PCS dual band portable radio. As present cellular telephone designs require multi-frequency radio capabilities, a directional coupler having dual band capabilities would offer a valuable product which can meet some of the present and future requirements of the telecommunications industry.

A dual band directional coupler need not be limited to cellular telephone or even telecommunications applications. The present invention contemplates any application in which two distinct frequency bands, anywhere in the electromagnetic spectrum, may require the use of a directional coupler. Nevertheless, at some point, the two frequency bands will be so far apart that it may no longer be viable or economical to manufacture the directional coupler in a laminated multilayer package. On the other hand, the minimum amount of overcoupling required is only enough to create two overcoupling regions. Even with a slight amount of over coupling, a lower frequency range of interest may be obtained which may offer advantages for certain applications.

Another embodiment involves using an overcoupled design in order to exploit only the low-side half-power coupling region 606 to obtain an off-center frequency ($F_{OC1}$) which is lower in frequency than the overcoupled center frequency ($f_o$). Only the low-side half-power coupling region 606 may be used to set the power splitting characteristics of the directional coupler. Advantageously, low-side half-power coupling region 606 will be less than one-quarter wavelength which means that the transmission lines will necessarily have a shorter physical length which means that the external dimensions of the multilayer package will be significantly reduced. Thus, by overcoupling and focusing on the low-side half-power coupling region 606, an ultra small multilayer directional coupler package can be achieved.

FIG. 6 shows graphically the over-coupling design, by purposefully over-coupling the transmission lines, to provide 3 dB coupling at two distinct frequencies. A 3 dB. coupling relationship is an industry recognized standard half-power coupling configuration wherein in the ideal case exactly half the input power in Port 1 couples and exits Port 2, exactly half the input power passes through and exits Port 3, and no power exits Port 4. In 3 dB coupling, the power output from the second transmission line is 3 dB below the original signal. The points at which the coupled output power (Port 2) equals the through output power (Port 3), are called "half-power coupling nodes" and the regions immediately surrounding the coupling nodes are called "half-power coupling sections".

Although true 3 dB coupling occurs at the nodal points, it is significant that effective 3 dB coupling occurs throughout the entire coupling section extending approximately 25–100 MHz on each side of the coupling nodes.

There is a caveat, however, which limits the realistic amount of coupling that can be achieved with this overcoupled design. Although effective coupling still occurs around the coupling nodes, the present design works best for narrow-band applications. In a narrow-band configuration, the over-coupling technique can provide sufficient coupling for many applications. Fortunately, many microwave, digital cellular telephone, and wireless communication applications require only narrow-band directional couplers.

The present directional coupler is designed to work best for narrow band applications. Frequency bands of about 5–10% bandwidths are considered typical narrow bands.

Referring to FIG. 6, note that one coupling section will be on the low side of the traditional coupling frequency and one coupling section will be on the high side of the traditional coupling frequency. The coupling section on the low side will have a transmission line which is less than one quarter wavelength long. Similarly, the coupling section on the high side will have a transmission line which is greater than one quarter wavelength long.

For the application where a small package single band directional coupler is desired, the low-side half-power coupling section will be utilized due to its shorter transmission line length. For an application where a dual band directional coupler is desired, both coupling sections will be utilized.

The directional coupler 300 contemplates a design in which it is overcoupled at an "overcoupled center frequency" ($f_o$) which is higher than the frequency at which 3 dB coupling is desired. The "overcoupled center frequency" ($f_o$) will be located between the 3 dB coupling frequency and the second harmonic. Next, the coupling coefficient (C') is adjusted until the coupling occurs in the desired frequency range of interest called the off-center frequency ($F_{OC1}$). Using the coupling equations disclosed herein, the physical length (l) of the transmission lines will be shorter since the electrical length at the frequency of interest is less than one quarter wavelength. Consequently, the overall external package dimensions with an overcoupled design will be less than a traditional directional coupler package which employs traditional coupling technology.

Advantageously, using an overcoupled design, allows the directional coupler 300 to be made smaller (external dimensions) with a decreased package size. Significantly, the overall height of the package is reduced because there are fewer dielectric layers in the package. This is important from a design perspective because of the criticality of the height requirements mandated by the portable phone industry. Typically, the present design can be made in a laminated structure including a set of dielectric substrates. The number of layers of dielectric substrates will depend on the specific application.

In one embodiment, the directional coupler 300 will have both a primary and a secondary transmission line disposed on many of the same substrates, and are substantially parallel to each other on a major surface, preferably the top or bottom of the substrate, to form an edge coupling technique. Additionally, the primary and secondary transmission lines will also be substantially vertically aligned through adjacent dielectric substrates to form a broadside coupling technique.

The broadside coupling technique does not necessarily need to be confined to only consecutive dielectric sheets. Although strong broadside coupling will occur between consecutive dielectric sheets, coupling will still occur if there are one, two or more dielectric layers between the transmission lines. For example, the broadside coupling may occur between every other dielectric sheet, every third dielectric sheet, or any other alternating or periodic pattern. Of course, the coupling will become weaker when the transmission lines are further distant from each other and it is important that no intervening electroded transmission lines interfere with the broadside coupling. Referring to FIG. 5, the broadside coupling occurs on alternate layers, however, the intermediate layers are left unelectroded or unmetallized in the region where broadside coupling occurs.

In summary, overcoupling at a higher frequency involves creating transmission lines which have a shorter electrical length and results in a smaller package size. Whereas traditional directional couplers set the coupling region at one location most desirably between the coupled transmission lines, an entirely new approach involves purposefully overcoupling in order to exploit another region of the coupler output port power line curves (see FIG. 6).

A significant feature of the present invention is the fact that by overcoupling at a higher frequency to achieve desired coupling at a lower frequency, the electrical length at the lower desired frequency will not be one quarter wavelength. This is significant because substantially all present directional coupler designs are believed to have transmission lines which are one quarter wavelength. A directional coupler design in which the transmission lines are less than one quarter wavelength allows for a smaller package to be used because the internal transmission lines have a shorter length than traditional one quarter wavelength directional couplers.

As is seen in FIG. 5, the transmission lines are placed in a multilayer package in a coiled configuration. Coiling the transmission lines in the package has the effect of increasing the inductance. As a result, the physical transmission line length is shorter for a given electrical length. In a preferred embodiment, the transmission lines may extend in a substantially coiled direction in order to increase inductance. A substantially coiled direction may be achieved by employing a substantially square, substantially circular, substantially diamond-shaped configuration or the like. Thus, the coiling of the transmission lines may result in a design with transmission lines of an even shorter physical length.

The transmission line design of FIG. 5 also advantageously meets other directional coupler specifications. With the design of FIG. 5, the directional coupler 300 can meet Isolation specifications, meaning that there is substantially no power at Isolation Port 4 of the coupled transmission line. Moreover, specifications for Return Loss are also met or exceeded with the present design.

The directional coupler 300 also uses a edge-broadside coupling transmission line coupling technique in which the transmission lines are both coupled side-by-side on each dielectric layer (edge coupling) as well as coupled substantially vertically through the multilayer package (broadside coupling). Although a preferred embodiment will contain edge-broadside coupled transmission lines, another variation which is also contemplated is a design in which the transmission lines are not substantially vertically aligned but rather offset in the multiple dielectric ceramic sheet layers. By offsetting the transmission lines, coupling is still provided and a large number of design variations are still possible.

It is important to note that although the pair of transmission lines will extend through various dielectric layers in various configurations, the overall physical length of the primary and the secondary transmission lines will be substantially the same throughout the package, in a preferred embodiment. From a design perspective, it is important that the transmission lines have the same physical length, in order to maintain substantially a ninety degree phase difference between the through and coupled outputs.

On any given layer, one transmission line may be positioned radially outside the other and on that particular layer that transmission line will have a greater physical length. However, on subsequent layers, the other transmission line will have the outer radial position. Thus, over the course of various layers, the overall physical length will be substantially the same, although that may not appear to be the case on any individual sheet of dielectric.

Still another design consideration involves the strategic placement of vias to extend the transmission lines through the package. Typically, each of the dielectric sheets (302–308 in FIG. 5) will have two pairs of through vias, one pair to accept the transmission line from a previous layer of dielectric and one pair to send the transmission line on to the next layer. These through vias, which have not been shown in FIG. 5 for reasons of clarity, will typically be filled with the same material that is used to form the electrode patterns which make up the transmission lines themselves. It should be understood that the transmission lines could be connected to subsequent layers in other ways as well, including side-electrodes or side-metallizations for example, in other applications.

Figure 7:
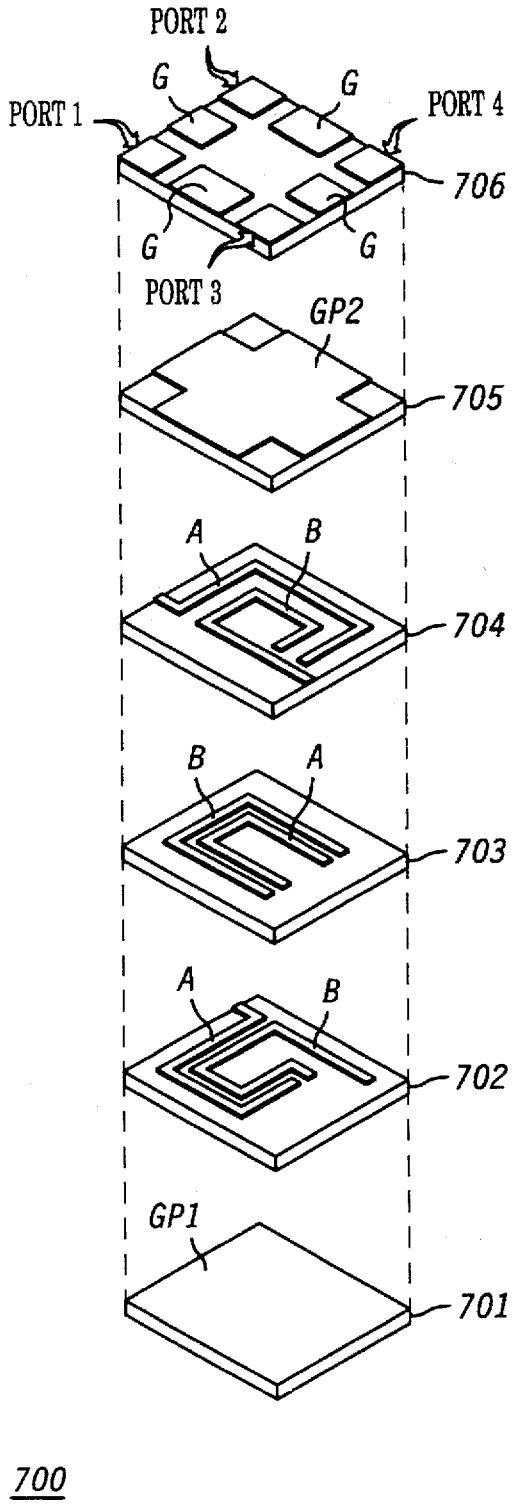
FIG. 7 shows another embodiment of a directional coupler in accordance with the present invention.

FIG. 7 shows another embodiment of the directional coupler. In FIG. 7, the primary transmission line and the secondary transmission line are coupled by a combination of edge type coupling and broadside type coupling. However, FIG. 7 is shown to provide an example of a broadside coupling technique in which the broadside coupling occurs over consecutive layers in the multilayer package. Also, this embodiment shows another input-output design possibility in which the input, output and isolation pads (Port 1, Port 2, Port 3 and Port 4) are placed on the corners of the package and the grounds, designated by the letter "G", are placed between the input, output and isolation ports.

Referring to FIG. 7, a set of six sheets of dielectric ceramic numbered 701 through 706 are laminated to form a multilayer directional coupler package 700.

Sheet 701 is substantially metallized on one surface to define a first or top ground plane GP1.

Sheet 702 contains a primary transmission line (A) and a secondary transmission line (B) deposited on a major surface of sheet 702.

Sheet 703 contains a primary transmission line (A) and a secondary transmission line (B) deposited on a major Surface of sheet 703. Significantly, the primary transmission line (A) on sheet 702 couples with the secondary transmission line (B) on sheet 703 as they are substantially vertically aligned. Similarly, the secondary transmission line (B) on sheet 702 couples with primary transmission line (A) on sheet 703. This embodiment shows a consecutive broadside coupling design.

Sheet 704 contains a primary transmission line (A) and a secondary transmission line (B) deposited on a major surface of sheet 704. Consecutive broadside coupling continues as the primary transmission line (A) on sheet 704 couples with the secondary transmission line (B) on sheet 703 and the secondary transmission line (B) on sheet 704 couples with the primary transmission line (A) on sheet 703.

Sheet 705 defines a buried second or bottom ground plane GP2. The term buried merely refers to the fact that the ground plane is not on a surface of sheet 706 but rather buried further into the multilayer package 700.

Sheet 706 contains input, output and isolation pads for the four ports of the directional coupler (Port 1, Port 2, Port 3, and Port 4) as well as grounded areas designated by the letter "G". Compared with FIG. 5, the input, output, isolation and ground configuration is slightly different. In both embodiments, the grounds are placed substantially near the ports for test fixture purposes. A decision as to whether to place the input, output and isolation pads on the corners or in the area between the corners will depend on the layout of the circuit board, the remaining architecture of the system, pad size, footprint and other design considerations. In a preferred embodiment, the input, output and isolation pad layout will be as shown in FIG. 5 for ease of manufacture and testing.

When sheets 701 through 706 are laminated into a multilayer ceramic package, a directional coupler 700 with a combination edge and consecutive broadside coupling design is achieved.

The present invention proposes a directional coupler in an ultra small multilayer package design. The directional coupler has a primary transmission line which includes an input and an output. The directional coupler also includes a secondary transmission line which has a first coupled output that is about 90 degrees out of phase with respect to the output of the primary transmission line and a second coupled isolation port is connectable to ground, possibly through a load resistor. In an ideal directional coupler, there will be no power at the second coupled isolation port. However, in any real system, there will be trace amounts of power, measured as isolation, that warrant the introduction of a load resistor or other similar device.

In a coupled transmission line arrangement, a fraction of a voltage incident upon the input Port 1 of a primary transmission line will couple to the second transmission line, while the remaining voltage will travel through the first transmission line to the output of the first transmission line (Port 3).

At any instant in time, if the voltages are measured at the input of the first transmission line (Port 1) and at the coupled output (Port 2) of the second transmission line, the polarity of the voltages will be either the same (positive and positive or negative and negative) or different (positive and negative or negative and positive). This is a result of different electromagnetic field distributions which lead to different polarity scenarios.

If the polarity is the same, then the mode of transmission is called "even-mode" and the corresponding characteristic impedance is even mode impedance. Conversely, in the instance when the polarity is reversed, the mode of transmission is called "odd-mode" transmission and its characteristic impedance is called odd mode impedance.

The relevant equations used to determine the even and odd mode impedances as well as the coupling coefficient and the physical length of a transmission line for a given frequency in a conventional directional coupler design can be derived as follows:

Let ($Z_0$) be the characteristic impedance of the external lines connecting to the coupler, let ($Z_{0e}$) be the even mode impedance, and let ($Z_{0o}$) be the odd mode impedance of the directional coupler, then:

$$Z_0^2 = Z_{0e} Z_{0o} \tag{1.1}$$

A coupling factor C' is related to the voltage amplitude of a wave incident upon Port 1 of the primary transmission line of the directional coupler and is expressed in decibels (dB) as:

$$C' = 20 \log \left| \frac{Z_{0e} - Z_{0o}}{Z_{0e} + Z_{0o}} \right| \tag{1.2}$$

From equations 1.1 and 1.2, we have:

$$Z_{0e} = Z_0 \sqrt{\frac{1 + 10^{C'/20}}{1 - 10^{C'/20}}} \tag{1.3}$$

and:

$$Z_{0o} = Z_0 \sqrt{\frac{1 - 10^{C'/20}}{1 + 10^{C'/20}}} \tag{1.4}$$

Now a line of electrical length θ radians in a medium of relative permittivity $\epsilon_r$ will have a physical length (1) given by:

$$1 = \theta c/2\Pi f\sqrt{\epsilon_r} \quad (1.5)$$

Where:

l=a physical length of the transmission line f=a frequency of interest measured in Hertz c=a speed of light.

For a quarter wavelength (λ/4) line: θ=Π/2

Therefore:

$$1_{\lambda/4} = c/4f\sqrt{\epsilon_r} \quad (1.6)$$

From equations 1.3, 1.4 and 1.6, a preliminary design for a traditional directional coupler with a known mid-band coupling factor (C') could be simulated using conventional coupling factor (C') could be simulated using conventional design software. From equation (1.5) above, a transmission line length can be determined when the frequency of interest is known.

Applying equation (1.5) to the overcoupled design of the present invention, when the electrical length, measured in radians, is about 9Π/26, the frequency of interest is about 900 MHz, and the relative permittivity of the dielectric sheets is about 7.8, then the physical length of the transmission line will be about 0.808 inches.

Now compare this with a conventional design, such as the prior art coupler shown in FIGS. 1 and 2, in which the electrical length is about Π/2, the frequency is about 900 MHz, and the relative permittivity of the dielectric sheets is about 7.8, then the physical length of the transmission line will be about 1.167 inches. As can be clearly seen through the use of these equations, by using an overcoupled design, the overall physical length of the transmission line is reduced substantially, resulting in a package which is substantially smaller as well.

Using the above equations, calculations could be run for an "over-coupled" directional coupler. In a directional coupler, coupling is achieved by bringing the primary and secondary transmission lines in close proximity to each other so that the electrical energy transfers from one transmission line to the other without the lines coming in direct physical contact with each other. A directional coupler is called "over-coupled" if a greater fraction of the incident power (Port 1) goes to the coupled output (Port 2) than goes to the through output (Port 3). Stated another way, a directional coupler is overcoupled if the coupling factor (C') is greater than −3 dB (about −2.3 dB for example).

EXAMPLE ONE

A directional coupler substantially as shown in FIG. 5 was manufactured using ten sheets of dielectric ceramic tape material. First, a 3 dB directional coupler at 900 MHz was determined to be the desired final product design. Rather than employing conventional coupling designs which would require a transmission line which was approximately 1.167 inches in length, the overcoupling technique of the present invention was employed resulting in a transmission line which was substantially shorter in length. As a direct result of this shorter transmission line requirement, a smaller package using less layers of dielectric ceramic was manufactured.

Using the equations (1.1 through 1.6) described above, the even and odd mode impedances as well as the transmission line length were determined. Next, using conventional design simulation software, a multilayer package design was created. Simulation parameters included the number of dielectric layers required, the optimum width for the transmission lines, the overall layout, the separation between the ground planes, as well as other electrical parameters such as impedance and coupling coefficients. From these simulations, a representative 3 dB directional coupler using an overcoupled design was realized.

Predetermined electrode pattern shapes were deposited on each layer. In a preferred embodiment, a silver conductive paste material was used. In a preferred embodiment, the transmission lines will typically be approximately 0.010 inches in width, approximately 0.0004–0006 inches in height, and be separated by approximately 0.010 inches on the dielectric sheets. The ten sheets were then laminated together under pressure and temperature using conventional multilayer processing techniques. The package was then fired to achieve complete densification. In a preferred embodiment, the dielectric sheets will be approximately 0.00375 inches thick after firing. The fired package had external dimensions of about 0.14 inches by about 0.165 inches by about 0.048 inches. The height dimension includes some unmetallized sheets (not shown) inserted for design purposes. These ultra-small overall external package dimensions are achievable because of the overcoupling design which results in transmission lines of shorter length.

Finally, input, output and isolation pads were patterned on the top surface of the package. A ground plane was strategically positioned on a second layer of dielectric to form a buried ground plane (this ground plane layer, formed by an electroded layer of metallization, could also be placed on the top surface of the directional coupler in another embodiment).

In order to achieve a desired frequency of interest in the range of about 900 MHz (suitable for cellular telephone applications), the transmission lines were overcoupled in a design in which the overcoupled center frequency is about 1300 MHz. This results in a transmission line which is less than one-quarter wavelength and a correspondingly small multilayer package.

Although example one shows a specific design in which the overcoupling technique was used to produce a standard 3 dB or half-power directional coupler, it should be understood that other coupling techniques can be achieved with the present invention. For example, a coupler which has less coupling than a traditional 3 dB coupler, such as a 6 dB or a 10 dB coupler could also be designed by those skilled in the art using the overcoupling technique of the present invention. As such, the present invention contemplates a technique for generating a variety of couplings in a very small volume requiring fewer layers of dielectric ceramic.

COMPARATIVE EXAMPLE ONE

A standard directional coupler available in the industry and which uses conventional coupling techniques, as shown in FIG. 2, was evaluated. It's external package dimensions were measured and determined to be about 0.130 inches by about 0.180 inches by about 0.080 inches. It is important to note that although this directional coupler was manufactured in a multilayer package, its external dimensions were significantly greater than the narrow band overcoupled directional coupler in a multilayer package of the present invention. More significantly, the directional coupler standard in the industry (without the overcoupled design) is about 69% larger in volume than the overcoupled directional coupler of the present invention. The standard directional coupler available in the industry does not employ an overcoupled design. As a result, the industry standard directional coupler has transmission lines of greater length leading to a larger sized package. Additionally, the height dimension off a printed circuit board is an important design consideration in portable electronic telecommunications equipment. The overcoupled directional coupler of the present invention has only about 60% of the height of other standard directional couplers in the industry.

Although various embodiments of this invention have been shown and described, it should be understood that variations, modifications and substitutions, as well as rearrangements and combinations of the preceding embodiments can be made by those skilled in the art without departing from the novel spirit and scope of this invention.

What is claimed is:

1. A directional coupler, comprising:

a laminated structure including a plurality of dielectric substrates, at least two dielectric substrates including a primary and a secondary transmission line disposed thereon;

the primary transmission line includes an input and an output, and the secondary transmission line includes a coupled output that is about 90 degrees out of phase with respect to the output of the primary transmission line and an isolation output that is connectable to ground;

the primary transmission line and the secondary transmission line are coupled by a combination of edge type coupling and broadside type coupling;

the edge type coupling comprising at least portions of the primary transmission line and the secondary transmission line being substantially parallel with each other on a major surface of one of the dielectric substrates and broadside type coupling comprising at least portions of the primary transmission line and secondary transmission line being substantially vertically aligned through an adjacent dielectric substrate; and the primary and secondary transmission lines being substantially overcoupled, defining an overcoupled region having an overcoupled center frequency and a high-side half-power cross-over node and a low-side half-power cross-over node, an area in proximity to the high-side half-power cross-over node and the low-side half-power crossover node defining a high-side half-power coupling region and a low-side half-power coupling region, at least one of the high-side half-power coupling region and low-side half-power coupling regions defining a predetermined off-center frequency which is different from the overcoupled center frequency.

2. The directional coupler of claim 1, wherein at least one of the high-side half-power coupling region and the low-side half-power coupling region comprises a predetermined power splitting characteristic of the directional coupler and half-power coupling occurs in this region.

3. The directional coupler of claim 1, wherein the low-side half-power coupling region defines a directional coupler which is less than one-quarter wavelength.

4. The directional coupler of claim 1, wherein the first and second transmission lines have substantially the same length.

5. The directional coupler of claim 1, wherein each of the dielectric substrates has at least two pairs of vias being conductively filled, for connecting the first and second transmission lines on consecutive layers.

6. The directional coupler of claim 1, wherein both the high-side half-power coupling region and the low-side half-power coupling region comprise half power points, defining a dual band directional coupler.

7. The directional coupler of claim 1, wherein the directional coupler is a 3 dB directional coupler.

8. The directional coupler of claim 1, wherein the directional coupler is less than about 3 dB at a frequency distant from the low-side half-power coupling region and the high-side half-power coupling region.

9. The directional coupler of claim 1, wherein the predetermined off-center frequency provides about 3 dB coupling.

10. The directional coupler of claim 1, wherein the combination of edge type coupling and broadside type coupling comprises the first and second transmission lines being partially vertically offset defining a combination of an offset and edge coupling technique.

11. The directional coupler of claim 1, wherein broadside coupling occurs between at least one of alternatingly and consecutively spaced dielectric substrates.

12. The directional coupler of claim 1, wherein the transmission lines are substantially overcoupled an amount sufficient to create a pair of coupling regions.

13. The directional coupler of claim 1, wherein the laminated structure further comprises, on a bottom surface thereof, an input pad and an output pad connected to the primary transmission line and an isolation pad and an output pad connected to the secondary transmission line.

14. The directional coupler of claim 1, wherein at least one of the first and second transmission lines include a transmission line length of less than about one-quarter wavelength $\theta<\Pi/2$ and a physical length 1 wherein:

$$1=\theta c/2\Pi f\sqrt{\epsilon_r}$$

and:

l=a physical length of a transmission line;

f=an off-center frequency measured in Hertz;

c=a speed of light;

$\epsilon_r$=a relative permittivity of the medium; and $\theta$=an electrical length measured in radians.

15. A directional coupler, comprising:

a laminated structure including a plurality of dielectric substrates, at least two dielectric substrates including a primary and a secondary transmission line disposed thereon;

the primary transmission line includes an input and an output, and the secondary transmission line includes a coupled output that is about 90 degrees out of phase with respect to the output of the primary transmission line and an isolation output that is connectable to ground;

the primary transmission line and the secondary transmission line are coupled by a combination of edge type coupling and broadside type coupling;

the edge type coupling comprising at least portions of the primary transmission line and the secondary transmission line being substantially parallel with each other on a major surface of one of the dielectric substrates and broadside type coupling comprising at least portions of the primary transmission line and secondary transmission line being substantially vertically aligned through an adjacent dielectric substrate; and the primary and secondary transmission lines being substantially overcoupled, defining an overcoupled region having an overcoupled center frequency and a low-side half-power cross-over node, an area in proximity to the low-side half-power cross-over node defining a low-side half-power coupling region providing a predetermined off-center frequency which is lower than the overcoupled center frequency.

16. The directional coupler of claim 15, wherein the overcoupled center frequency is about 1300 Mega-Hertz and the off-center frequency is about 900 Mega-Hertz.

17. The directional coupler of claim 15, wherein the laminated structure further comprises, on a bottom surface thereof, an input pad and an output pad connected to the primary transmission line and an isolation pad and an output pad connected to the secondary transmission line.

18. The directional coupler of claim 15, wherein the first transmission line provides a first power line characteristic and the second transmission line provides a second power line characteristic substantially inversely related to the first power line characteristic, defining an overcoupled region.

19. The directional coupler of claim 15, wherein a fourth and a sixth and an eighth dielectric substrate include the first and second transmission lines being substantially broadside coupled.

20. The directional coupler of claim 15, wherein a second dielectric sheet provides a layer of metallization defining a buried ground plane.

* * * * *